US007598685B1

(12) United States Patent
Shteynberg et al.

(10) Patent No.: US 7,598,685 B1
(45) Date of Patent: Oct. 6, 2009

(54) OFF LINE LED DRIVER WITH INTEGRATED SYNTHESIZED DIGITAL OPTICAL FEEDBACK

(75) Inventors: Anatoly Shteynberg, San Jose, CA (US); Harry Rodriguez, Gilroy, CA (US)

(73) Assignee: Exclara, Inc., Santa Clara, CA (US)

( * ) Notice: Subject to any disclaimer, the term of this patent is extended or adjusted under 35 U.S.C. 154(b) by 234 days.

(21) Appl. No.: 11/231,126

(22) Filed: Sep. 19, 2005

Related U.S. Application Data

(60) Provisional application No. 60/611,162, filed on Sep. 20, 2004.

(51) Int. Cl.
*H05B 37/02* (2006.01)

(52) U.S. Cl. ..... 315/308; 315/283; 315/287; 315/224; 315/312

(58) Field of Classification Search ..... 315/209 R, 315/210, 224–225, 246, 283, 287, 291, 307–309, 315/312–313, 362
See application file for complete search history.

(56) References Cited

U.S. PATENT DOCUMENTS 6,057,651 A * 5/2000 Usami ..... 315/291
6,078,148 A * 6/2000 Hochstein ..... 315/291
6,127,789 A * 10/2000 Ishizuka et al. ..... 315/308
6,577,072 B2 * 6/2003 Saito et al. ..... 315/185 R
7,511,436 B2 * 3/2009 Xu ..... 315/307
2002/0030455 A1 * 3/2002 Ghanem ..... 315/291
2002/0158590 A1 * 10/2002 Saito et al. ..... 315/291
2003/0117088 A1 * 6/2003 Tanabe et al. ..... 315/291

OTHER PUBLICATIONS

Semiconductor Components Industries. "Offline LED Driver" ON Semiconductor, Mar. 2003, pp. 1-6.
Walding, Carl. "High Current LED—Isolated Low Voltage AC Drive Application Note" ON Semiconductor, Oct. 2003, pp. 1-12.

* cited by examiner

*Primary Examiner*—David Hung Vu
*Assistant Examiner*—Tung X Le
(74) *Attorney, Agent, or Firm*—Nancy R. Gamburd; Gamburd Law Group LLC

(57) ABSTRACT

The present invention creates an LED driver in which all feedback signals are derived from a power stage media, and presents an isolated off-line LED driver with an accurate primary side controller only to power one or more LEDs. The present invention further provides an effective off-line LED driver comprising AC current shape controller with a minimum number of components. The present invention further provides a high quality luminous system based on LED drivers with the integrated synthesized optical feedback to compensate for imperfections of the LEDs as sources of light.

41 Claims, 10 Drawing Sheets a) – discontinuous mode
b) – continuous mode

OFF LINE LED DRIVER WITH INTEGRATED SYNTHESIZED DIGITAL OPTICAL FEEDBACK

RELATED APPLICATIONS

This application claims priority to Provisional Application Ser. No. 60/611,162, filed Sep. 20, 2004, the benefit of the filing date of which is hereby claimed under 35U.S.C. § 119(e).

BACKGROUND

1. Field

The present invention relates to LED drivers, and more particularly to off-line LED drivers with integrated synthesized digital optical feedback.

2. Related Art

Capacitive drop off-line LED drivers are known (On Semiconductor Application Note AND8146/D). However, this non-isolated driver has low efficiency, delivers relatively low power, and delivers a constant current to the LED but with no temperature compensation, no dimming arrangements, and no protection for the LED.

A few isolated off-line LED drivers are known:

With line frequency transformer and current regulator, On Semiconductor Application Note AND 8137/D;

Off-line LED driver with NCP1014P100 current mode controller, On Semiconductor Application Note AND8136/D;

White LED luminary Light Control System, U.S. Pat. No. 6,441,558;

LED Driving Circuitry with Light Intensity Feedback to Control Output Light Intensity of an LED, U.S. Pat. No. 6,153,985;

Non-Linear Light-Emitting Load Current Control, U.S. Pat. No. 6,400,102;

Flyback as LED Driver, U.S. Pat. No. 6,304,464;

Power Supply for LED, U.S. Pat. No. 6,557,512; and

Voltage Booster for Enabling the Power Factor Controller of a LED Lamp Upon Low AC or DC Supply, U.S. Pat. No. 6,091,614.

These drivers in general are too complicated as they use secondary side signals which have to be coupled with the controller on the primary side across the isolation.

For a high quality optical system multiple LED system parameters may be measured, which makes almost impossible the technical task of taking these signals across the safety isolation to feed controllers which reside on the primary side.

SUMMARY

An off-line LED Driver controls the optical output of a luminous system of variable number of LED by providing electrical energy as a constant DC or PWM voltage. An integrated digital model of the LED, in addition to LED current and forward voltage drop sense, provides feedback to a switch mode power converter configured to maintain a high quality of desired lumen output. The power converter further is structured to have either non-isolated or isolated topology. An isolated structure is implemented either by a two stage power converter or a single stage off-line converter. The power converter contains a controller coupled to primary side signals only. Further, the switch mode power converter forms AC input current to be the same shape as input voltage with high power factor and low THD. To achieve the required light source characteristics, the regulator modulates the duty cycle by keeping the desired LED current proportional to the integral of the LED forward drop voltage taken within an on-time of the primary switch. The system has two modes of operation: a) current mode /DC voltage, and b) PWM mode for deep dimming or extreme temperatures. The driver works both in continuous and discontinuous mode of operation.

DETAILED DESCRIPTION

Figure 1:
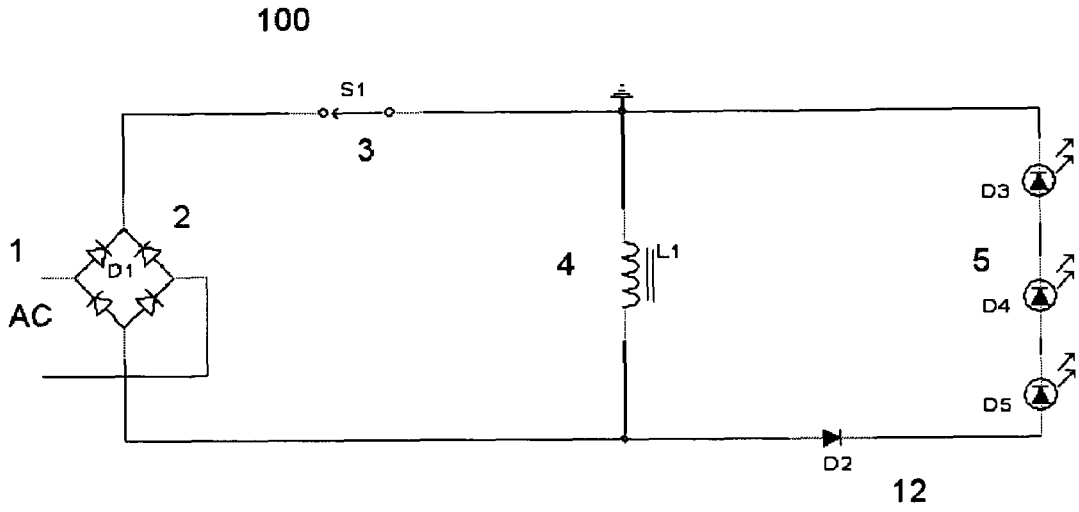
FIG. 1 illustrates an off-line non-isolated LED driver (power stage) in accordance with the present invention.

As illustrated in FIG. 1, the present invention shapes average current (or voltage) as LED brightness may require by converting AC line energy using switch 3, connected with its first terminal to the first terminal of the AC Bridge 2. The second terminal of the bridge 2 is connected to the first terminal of the magnetic inductor 4, and its second terminal is connected to the second terminal of the switch 3. The string of LED 5 is connected to the second terminal of inductor 4 and its first terminal via a preferably Schottky rectifier 12. The DC ground of the system is connected to the second terminals of the switch 3 and inductor 4.

Figure 2:
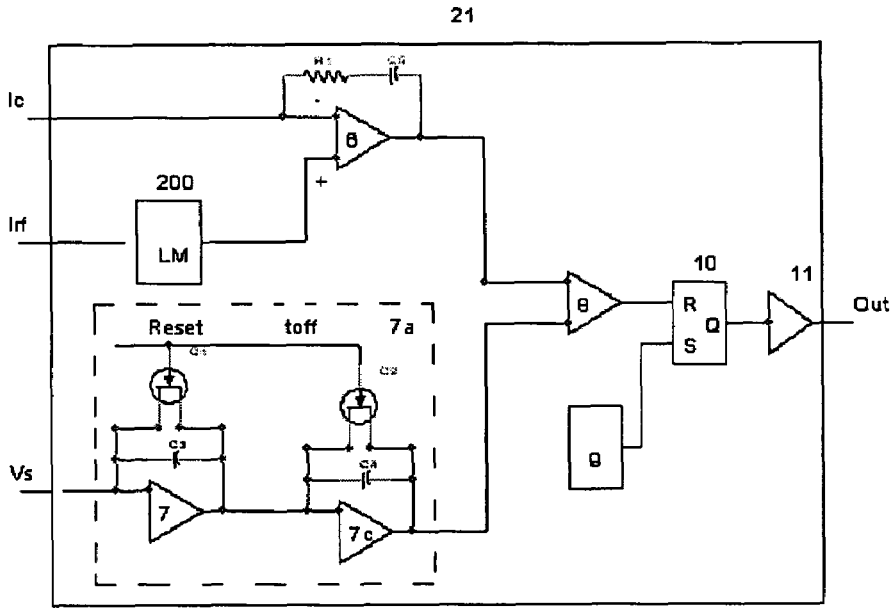
FIG. 2 illustrates a regulator in accordance with the present invention.
Figure 4:
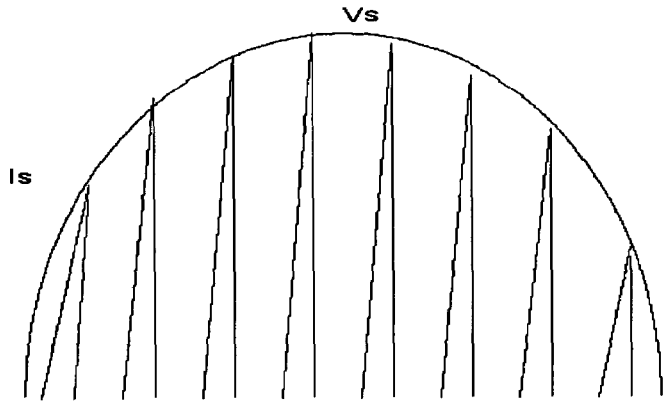
FIG. 4 illustrates current waveforms for the LED driver in FIG. 1 at low frequencies.
Figure 5:
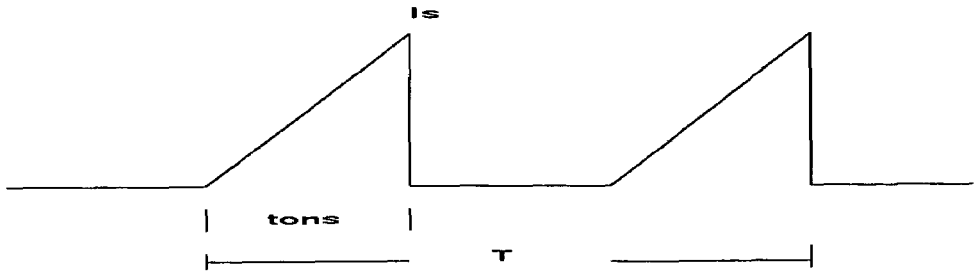
FIG. 5 illustrates current waveforms for the LED driver in FIG. 1 at high frequencies.

The block diagram of the controller to drive switch 3 is presented in FIG. 2, and current waveforms through switch 3 are illustrated in FIG. 4 and FIG. 5.

Current in the inductor 4 is discontinuous, its peak value is as follows:

$$I_s = \frac{V_s * t_{ons}}{L} \tag{1}$$

where $I_s$ is the peak current, $t_{ons}$ is the on time,

L is the inductance, and $V_s$ is the instantaneous voltage of the AC line.

Average value of $I_s$ current is:

$$I_{sav} = \frac{V_s * t_{ons}^2}{2L * T} \tag{2}$$

where T is the cycle time.

If the conversion frequency is constant, T=const and within the AC line the cycle on-time $t_{ons}$ is unchanged, then the average current $I_{sav}$ is:

$$I_{sav} = k * V_m \sin \omega t \tag{3}$$

where $$K = \frac{t_{ons}^2}{2L * T}$$

$V_m$—is the amplitude of the AC Voltage.

Equation (3) is a law for a regulator to shape a sinusoidal input current and to provide close to unity power factor and close to zero THD. Such a regulator 21 is illustrated in FIG. 2.

Regulator 21 has two loops: a current mode with an error amplifier 6, and voltage mode with integrators 7*a*. The error amplifier 6 is connected with its negative terminal to the current sense of LED $I_c$. The positive terminal of error amplifier 6 is connected to the LED model 200, which in one embodiment of the invention has an optional customer set signal for an optical output $I_{ref}$. In another embodiment of the invention, the customer $I_{ref}$ signal provides level of LED junction temperature. At this configuration, the model 200 will be a thermal LED model. The model 200 and $I_{ref}$ signal will determine a set current through LED per required luminous output (or junction temperature) of LED light system. $I_{ref}$ signal has a user interface to be changed for dimming purposes. Forward voltage sensor of rectified voltage $V_s$ is connected to the input terminal of an integrator 7. Integrator 7 has a reset switch, enabling integrator 7 to integrate only during on time of the switch 3. During off time of the switch 3, the integrator 7 is in the reset status.

During the integration the output of integrator 7 is:

$$V7 = \int_0^{ton} VS\,dt = Vston \tag{4}$$

The second integrator 7*c* with the same reset switch activated at off time is connected with its input terminal to the output of the first integrator 7. And the output of integrator 7*c*:

$$V7c = \int_0^{ton} VSton\,dt = \frac{Vston^2}{2} \tag{5}$$

Equation (5) is a mathematical model of converter equation (2). Keeping V7c constant will allow the control of the average input current according to the equation (2).

The output of the error amplifier 6 is connected to the first terminal of comparator 8. Its second terminal is connected to the output of integrator 7*c*. The output of the comparator 8 is connected to the reset terminal of latch 10. The set terminal of the latch 10 is connected to the oscillator 9. The latch 10 is connected to the switch driver 11. At the rising edge of the clock 9 the latch 10 is set and switch 3 (FIG. 1) is turned on by the driver 11. When comparator 8 goes high it resets the latch 10. The driver 11 turns the switch 3 off. At the next clock of oscillator 9 the switching cycle will resume.

Figure 2A:
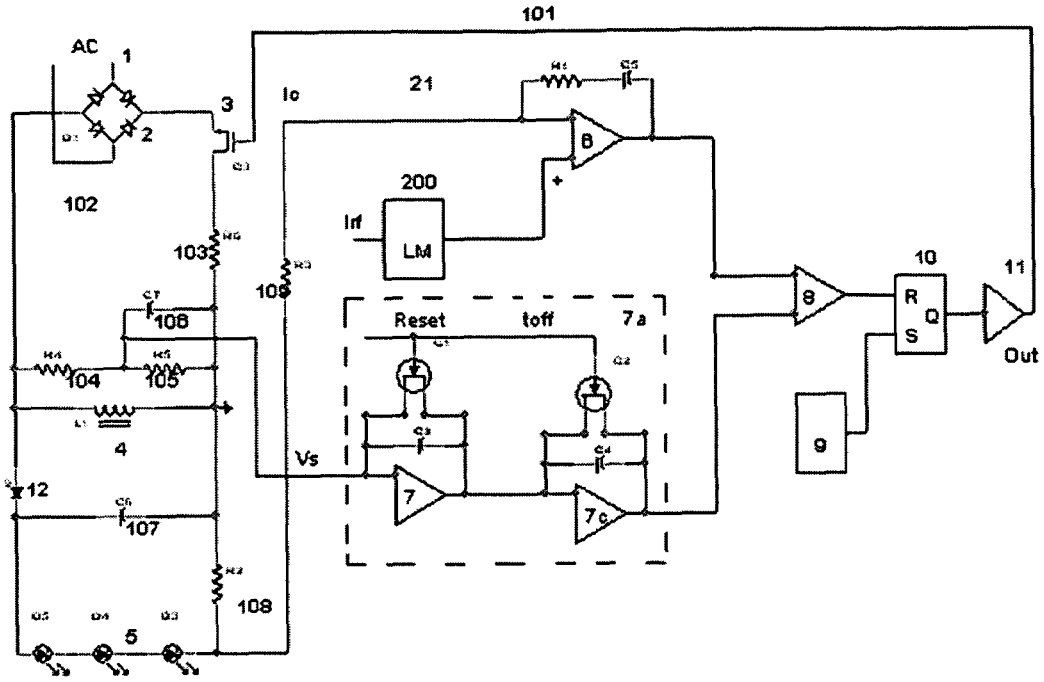
FIG. 2*a* illustrates an AC/DC converter with a regulator.

The LED driver 101 illustrated in FIG. 2*a* includes the controller 21 coupled to the converter 102, which is based on the converter 100, and further including:

- Primary current sense resistor 103 connected between switch 3 and system ground;
- Primary voltage sense resistors 104 and 105, connected across inductor 4;
- Filter capacitor 106 across resistor 105;
- The output filter capacitor 107 connected to the cathode of the rectifier 12 and system ground;
- The secondary current sense 108, connected between a cathode of LED and system ground;
- A coupling resistor 109 connecting current sense resistor 108 to the negative input of error amplifier 6 of the regulator 21

Figure 3A:
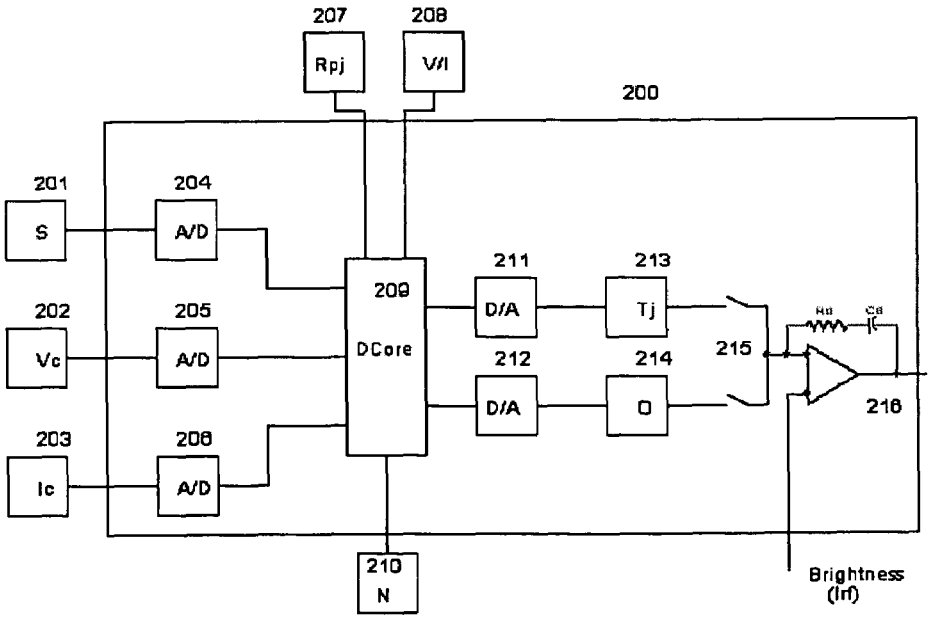
FIG. 3*a* illustrates a LED model.

The present invention creates a practical and effective feedback system using LED models. A variety of known LED models may be used for this purpose. FIG. 3*a* illustrates an example of a two channel brightness and thermal LED model 200. In a first channel, the voltage drop across LED is sensed by a sensor $V_c$ 202 and current through LED by a sensor 1203. The voltage sensor 202 is connected to an A/D converter 205. The current sensor 203 is connected to an A/D converter 206. The converters 205 and 206 are connected to the digital core 209. A number N of serially connected LED's is stored in the digital core 209. Also stored in the digital core 209 is a tested manufacturing relationship of LED V/I electrical parameter to its optical output (208). Based on signals from 202, 203, 210 and 208, the digital core 209 calculates the optical output. This signal is connected to a D/A converter 212 and a block 214 in which the optical output is modeled by an analog signal. This analog signal is connected to a negative terminal of the error amplifier 216 via switch 215. The positive terminal of the error amplifier 216 is connected to a customer interface signal $I_{ref}$, which sets the output brightness in this case.

The second channel of the thermal model 200 comprises a sensor S of the ambient temperature ("Ta") 201 connected to the digital core 209 via an A/D converter 204. The signals 202, 203, 210 are also being used to create an analog signal of junction temperature Tj in the block 213. A power loss in a single LED is calculated by the digital core 209 as:

$$Pl = \frac{VcIc}{N} \tag{6}$$

A manufacturing parameter of thermal resistance pin to junction Rpj is stored in the block 207 which is connected to the digital core 209. The digital core 209 calculates the real junction temperature:

$$Tj = Ta + RpjPl \tag{7}$$

The output of the thermal channel of the digital core 209 is connected via D/A 211 to the analog block 213. The output signal of the analog block 213 is connected to the negative terminal of the error amplifier 216 via switch 215. The positive terminal of the error amplifier 216 is connected to the customer interface signal $I_{ref}$, which in this case is a junction temperature set signal.

The selection of a brightness or thermal model is done by switch 215.

According to the invention, a non-contact method for creating an optical feedback signal comprises the following steps:

Storing in the digital form the number of serially connected LEDs N;

Storing in the digital form the manufacturing relationship between V/I electrical signal and optical output in $L_m$;

Measuring a voltage across serially connected LEDs and converting it into the digital form;

Measuring a current through LEDs and converting it into the digital form;

Calculate V/I point;

Using manufacturing data, calculate optical output;

Converting optical output from digital to analog form;

Comparing calculated optical output with a set signal in an error amplifier; and Using the error amplifier signal as a set signal in the power converter regulator.

Those skilled in the art may use a variety of other LED models to create a non-contact feedback for an LED driver according to this invention. More accurate models may be used also. For example, calculations of the optical output may be used complementary to V/I point junction temperature adjustment.

According to another embodiment of the invention the following process is suggested for a non-contact thermal feedback of a LED driver:

Storing in the digital form a number of serially connected LEDs N;

Storing in the digital form the manufacturing value of a thermal resistance pin to junction;

Measuring a voltage across a string of LEDs and converting it into the digital form;

Measuring a current via LEDs and converting it into the digital form;

Calculating power loss in a single LED by multiplying a measured voltage by current and dividing by the number of LEDs;

Sensing ambient temperature and converting it into the digital form;

Calculating a LED junction temperature by adding ambient temperature to the product of power losses in an LED by thermal resistance pin to the junction;

Converting a junction temperature into an analog signal;

Comparing a calculated junction temperature with a set signal in an error amplifier; and Using the error amplifier signal as a set signal in the power converter regulator.

Figure 3B:
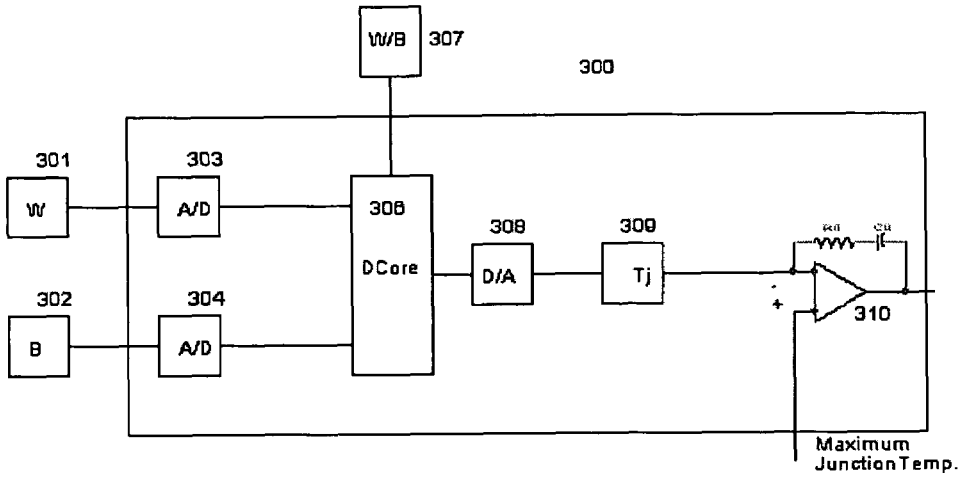
FIG. 3*b* illustrates a W/B LED model.

FIG. 3*b* illustrates a model 300 for thermal feedback based on a non-contact method of determining junction temperature of phosphor-converted white LED, according to a theory published by Prof. Nadarajan Narendran. The feedback model includes a sensor 301 of total radiant energy W connected to a digital core 306 via an A/D converter 303. A sensor 302 of the radiant energy within the blue emission (B) is connected to the digital core 306 via an A/D converter 304. A relationship of W/B ratio to the LED junction temperature in the analytical or table forms is stored in the block 307, connected to the digital core 306. Based on the W/B ratio, the digital core 306 calculates the junction temperature Tj. The output of the digital core 306 is connected to analog block 309 via a D/A converter 308. The output of the analog junction temperature block 309 is connected to the negative terminal of the error amplifier 310. The positive terminal of the error amplifier 310 is connected to a set signal of maximum junction temperature. The output of the error amplifier 310 is connected to the error amplifier of the power converter.

The following process is suggested for creating a thermal feedback of LED Driver using the W/B ratio:

Storing a relationship between the W/B ratio and the junction temperature in the digital form;

Measuring the total radiant energy W of the radiant energy and converting it into the digital form;

Measuring the radiant energy within the blue emission (B) and converting it into the digital form;

Calculating the W/B ratio;

Calculating the junction temperature;

Converting the junction temperature signal into the analog form;

Comparing the calculated junction temperature with a set signal in an error amplifier; and Using the error amplifier signal as a set signal in the power converter regulator.

The construction and process of creating feedback signals based on FIGS. 3*a* and 3*b* are applicable to when the LED model is used as a feedback signal for the LED regulation. However, the controller 21 can be configured such that the main feedback signal is LED DC current, then the described above LED models may be used for the adjustment of DC current feedbacks. In these cases, amplifiers 216 or 310 should be removed and direct analog signals 213, 214 or 309 could be used for the DC feedback adjustments (for example, adjustment of forward DC current based on real junction temperature to maintain the desired optical output).

The regulator 21 in FIG. 2 is described and presented in the analog form. It should be understood as an architecture, which may be implemented in different ways by those skilled in the art without departing from the spirit and scope of the present invention. For example, the regulator 21 can be implemented in the digital form. If so, then the feedback models 200 and 300 described as analog models should be implemented in the digital form as well. It is conceivable then that D/A converters 211, 212 and 308, as well as analog blocks 213, 214 and 309, should be removed. The error amplifiers 216 and 310, if functionally needed, should be realized in the digital form.

Figure 6:
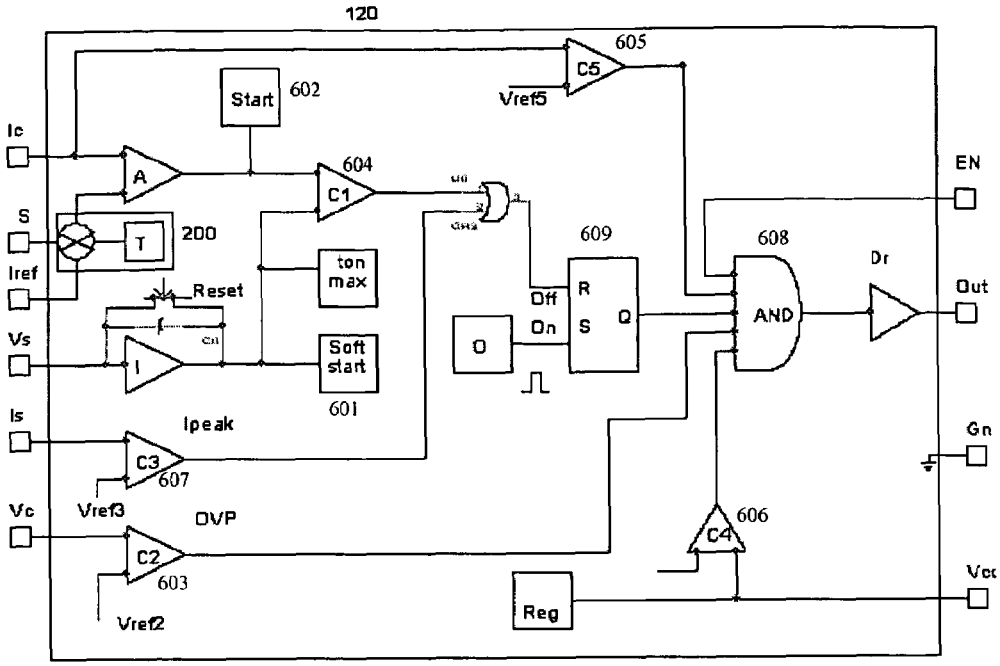
FIG. 6 illustrates a block diagram of a controller in accordance with the present invention.

A block diagram of a controller 120 is presented in FIG. 6. On top of fundamental functions presented in FIG. 2, it includes:

Soft start circuit 601 connected to the output of integrators 7*a;*

Start up circuit 602, connected to the output of error amplifier 6;

OVP circuit C2 603, connected to the input logic of the driver 11;

Maximum on time limit 604, connected to the output of integrator 7*a;*

LED current limit comparator C5 605 connected to the LED current sense $I_c$;

Controller $V_{cc}$ power on reset comparator 606; and

Input peak current limiter comparator C3 607, connected to the Input current sense $I_s$.

A functional AND logic 608 is connected with its input to the output of latch Q 609 to interface this signal to the driver. Logical signals from LED current limit comparator C5 605, enable signal EN, OVP comparator C2 603, and power on reset comparator C4 606 are assembled at the input of AND logic 608. If any of these signals goes inactive, the AND logic 608 is blocked and the switch 3 (FIG. 1) remains in the off position.

Figure 7:
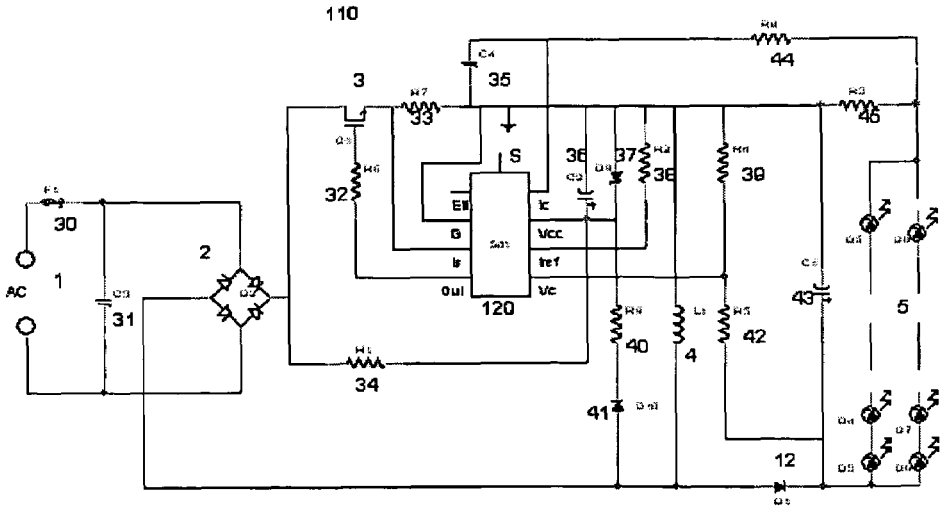
FIG. 7 illustrates a non-isolated off-line LED driver in accordance with the present invention.

A practical off line non-isolated LED system is illustrated in FIG. 7. According to this embodiment of the invention, the off-line LED driver 110 comprises the buck-boost converter 100 (FIG. 1) and further includes:

Input fuse 30;

Input EMI filter 31;

Gate drive resistor 32, connected between power switch 3 and controller 120;

Primary current sense 33, connected between power switch 3 and ground;

$V_{cc}$ precharge resistor 34, connected between the positive port of rectifier 2 and the $V_{cc}$ capacitor 36;

$V_{cc}$ protection zener diode 37, connected across the $V_{cc}$ capacitor 36;

Output voltage sense 39 and 42, connected to the controller 120;

Current sense filter 35, 44, connected between current sense resistor 46 and the controller 120;

$V_{cc}$ supply resistor 40 and diode 41 connected to the anode of rectifier 12; and LED filter 43 connected across LEDs 5 anodes and ground.

When the input AC Voltage 1 is applied the $V_{cc}$ capacitor 36 is charged via resistor 34 and inductor 4. This is an additional network to precharge the capacitor 36 as ground is connected to the positive rail of the rectified voltage. When controller 120 is turned on, it starts driving the power switch 3, and voltage builds across output 5. The $V_{cc}$ energy then is supplied by the inductor 4 via blocking diode 41 and current limiting resistor 40.

Enable pin EN is being used for enabling/disabling the Driver and for LED dimming via a pulse width modulator (PWM).

Figure 8:
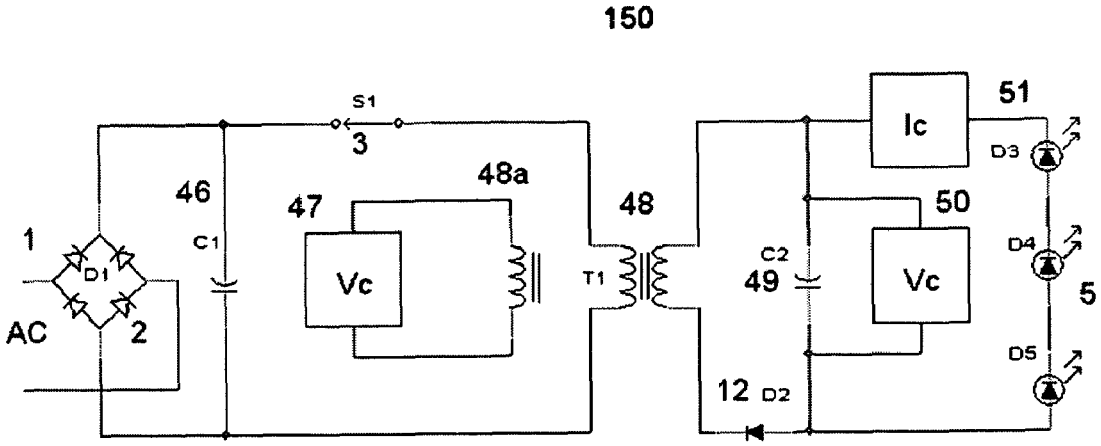
FIG. 8 illustrates a block diagram of the isolated driver in accordance with the present invention.

A block diagram of an isolated LED driving system is illustrated in FIG. 8. The first terminal of the AC bridge 2 is connected to the first terminal of switch 3. A second terminal of switch 3 is connected to the first terminal of the first primary winding of the transformer 48. The second terminal of the first primary winding of transformer 48 is connected to the second terminal of the bridge 2. LEDs 5 are connected to the secondary winding of the transformer 48 in the flyback configuration via Schottky rectifier 12. The second primary winding 48*a* of the transformer 48 is connected to the circuit generating the $V_c$ signal proportional to a $V_c$ voltage across the LEDs 5. A primary capacitive filter 46 is connected across the output of the bridge 2, and secondary capacitive filter 49 is connected across LEDs 5. A current sense circuit 151 is connected in series with the LEDs 5.

The converter 150 in FIG. 8 will keep up with the law in equation (3), delivering high power factor if input signals to its controller 160 (FIG. 13) are processed to be transmitted over an isolation barrier and to be compliant with the regulator 21 requirements (FIG. 2).

Figure 9:
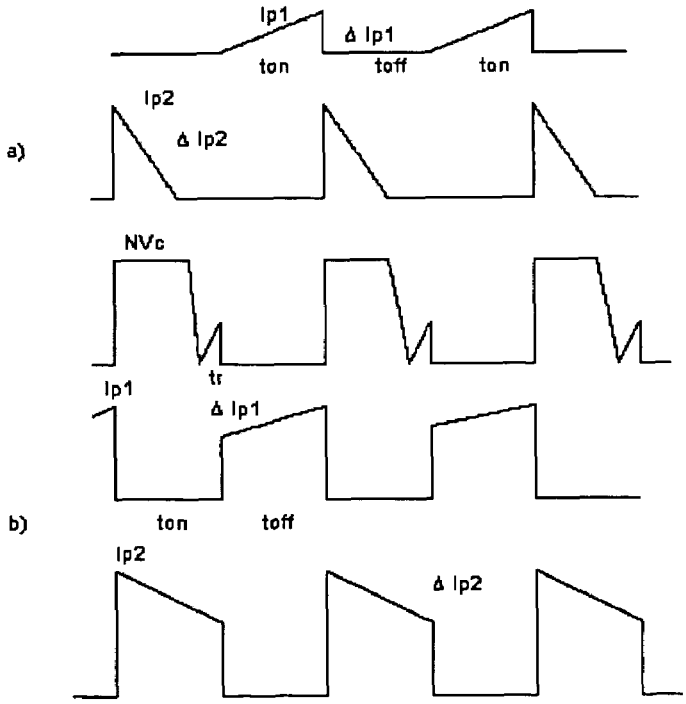
FIG. 9 illustrates primary side current waveforms.

Primary and secondary current waveforms for the converter 150 in FIG. 8 are presented in FIG. 9. Here:

$$\Delta I_{p1} = \frac{V_s * t_{ons}}{L_m} \tag{8}$$

where $\Delta I_{p1}$ is the change of the primary current, and $L_m$ is the magnetizing inductance of the transformer; and $$\Delta I_{p2} = \frac{N * V_c t_{rs}}{L_m} \tag{9}$$

where $\Delta I_{p2}$ is the change of the secondary current,

N is the transformer ratio, $V_c$ is the output voltage, and $t_{rs}$ is the reset time of the transformer.

Finding $L_m$ from equation (4) and substituting it in equation (5), an expression for $V_c$ follows:

$$Vc = \frac{\Delta I_{p2} V_s t_{ons}}{N t_{rs} \Delta I_{p1}} \tag{10}$$

Figure 10:
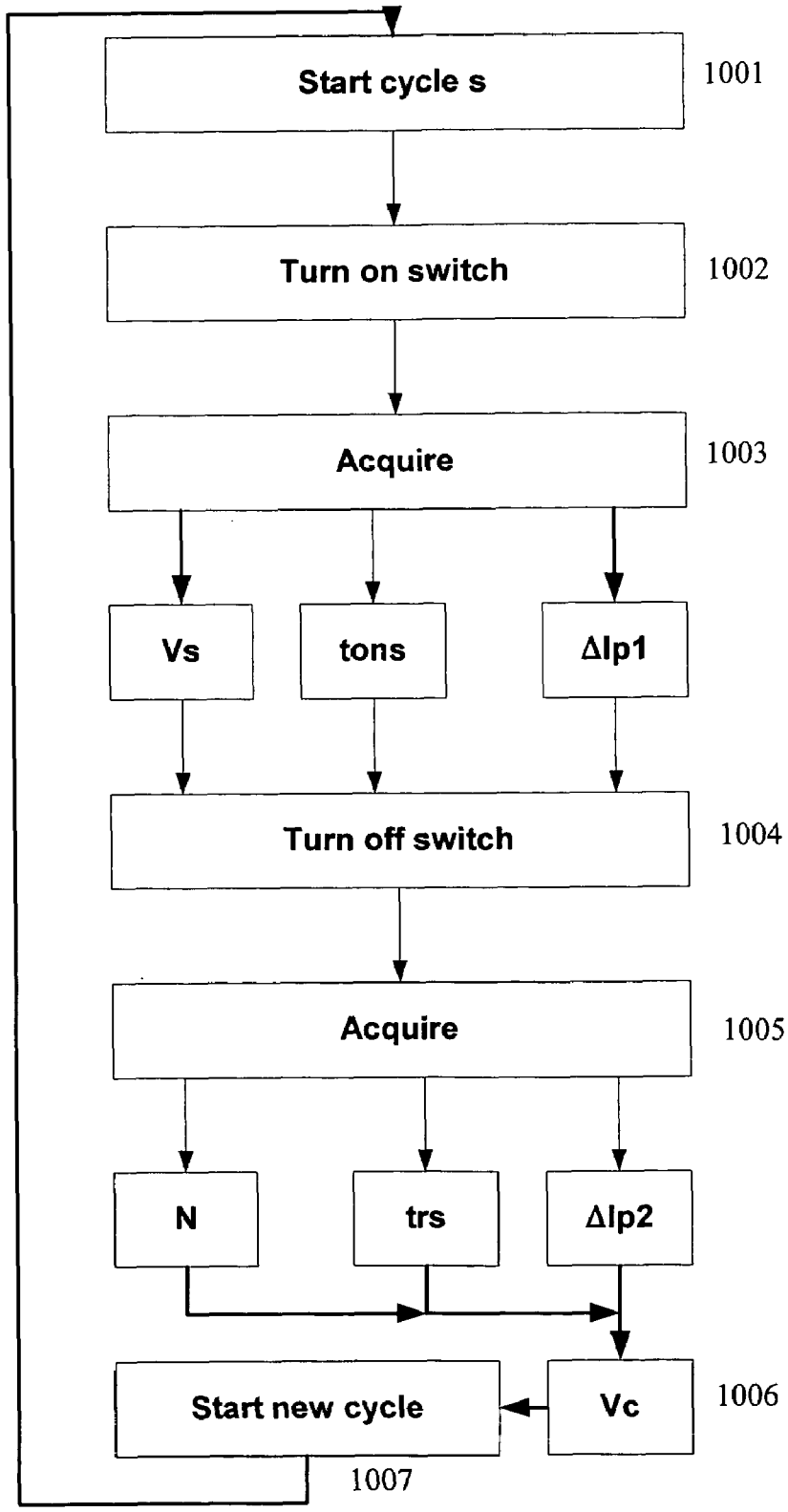
FIG. 10 illustrates an algorithm for $V_c$ calculation in accordance with the present invention.

The process for finding the secondary feedback signal $V_c$ on the primary side is illustrated in the flow chart in FIG. 10. This algorithm applies for both steady state and transients for discontinuous as well as continuous modes of operation and comprises the following steps:

Starting cycle s, via step 1001;

Turning on a switch, via step 1002;

Acquiring $V_s$, $t_{ons}$, $\Delta I_p$, via step 1003;

Turning off the switch, via step 1004;

Acquiring N, $t_{rs}$, $\Delta I_{p2}$, via step 1005;

Calculating $V_c$ per equation (10), via step 1006; and

Starting a new cycle, via step 1007.

A simplified algorithm can be suggested for a steady state when $N\Delta I_{p1}=\Delta I_{p2}$ $$Vc = \frac{V_s t_{ons}}{t_{rs}} \tag{11}$$

Figure 11:
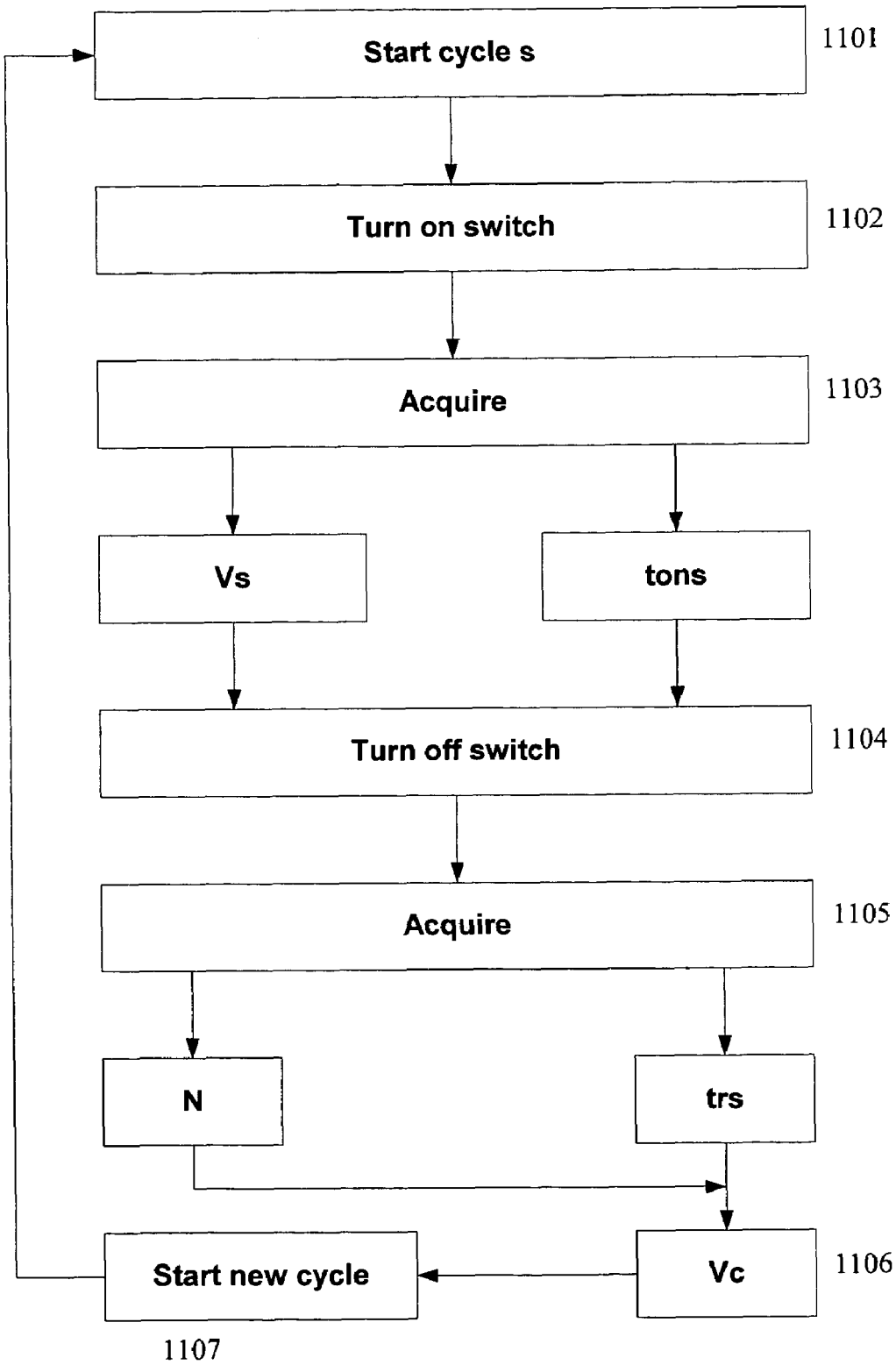
FIG. 11 illustrates a simplified algorithm for $V_c$ calculation in accordance with the present invention.

The simplified process is illustrated in the flow chart of FIG. 11 and comprises the steps of:

Starting cycle s, via step 1101;

Turning on a switch, via step 1102;

Acquiring V, and $t_{ons}$, via step 1103;

Turning off the switch, via step 1104;

Acquiring $t_{rs}$, via step 1105;

Calculating $V_c$, via step 1106; and

Starting a new cycle, via step 1107.

The secondary average current $I_c$ for a discontinuous mode can be also found on the primary side:

$$Ic = \frac{N I_{p1} t_{rs}}{2T} \tag{12}$$

Figure 12:
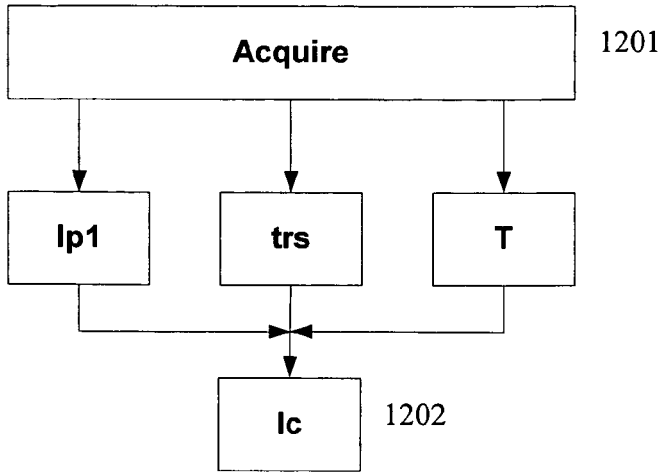
FIG. 12 illustrates an algorithm for a definition of the secondary side average current.

The subsequent process to define secondary current is presented in FIG. 12 and comprises the following steps in addition to the steps in FIGS. 10 and 11:

Acquiring at off time $I_{p1}$, $t_{rs}$, and T, via step 1201; and

Calculating $I_c$ per equation (12), via step 1202.

Figure 13:
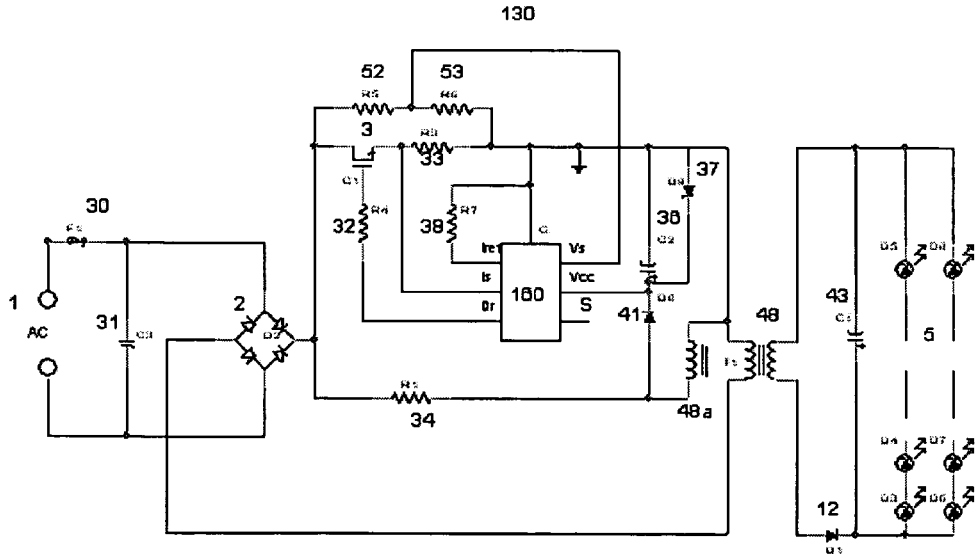
FIG. 13 illustrates an off-line LED isolated driver with a single discontinuous power stage.

In another embodiment of the invention, an implementation of the off-line LED driver based on primary control algorithms as illustrated in FIGS. 10,11, and 12 is illustrated in FIG. 13 The system in FIG. 3 is quite simple and provides a high quality luminous system. The off-line LED driver 130 is based on the isolated converter 150 illustrated in FIG. 8 and further comprises:

Input fuse 30 connected between AC line 1 and input terminal of bridge 2;

Current sense resistor 33 connected in series with the switch 3;

Voltage sense resistive divider 52, 53 connected across the switch 3;

$V_{cc}$ capacitor 36 connected via rectifier 41 to the second primary winding 48*a* of the transformer 48;

$V_{cc}$ protection zener diode 37, connected across $V_{cc}$ capacitor 36;

Controller 160, including functions of the processes in FIGS. 10, 11, and 12, and connected with its terminals to the gate resistor 32, current sense resistor 38, $V_{cc}$ capacitor 36, voltage sensor 52, 53, and feedback signal S.

Figure 14:
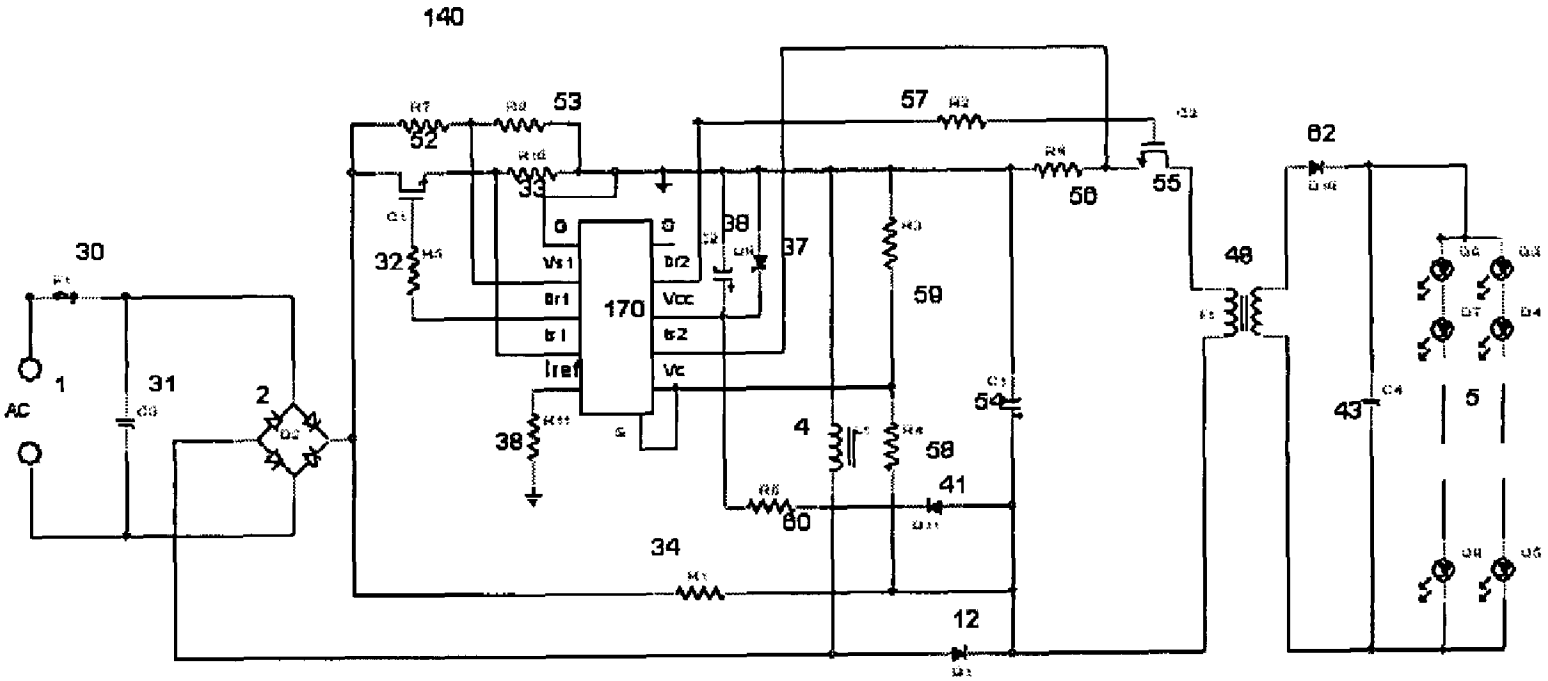
FIG. 14 illustrates an off-line LED isolated driver with double power conversion.

The switch mode converter 130 in FIG. 13 is running in discontinues mode. A single stage power factor corrected converter has a natural limit of processed power to about 100-120 W. If a LED light system requires more power, then a two stage system will be a better fit. Such a system 140 is presented in FIG. 14. The two stage system 140 has a combined controller 170 comprising two parts: a voltage source with power factor correction; and a current regulator based on a synthesized optical feedback similar to controller 160 (FIG. 13). The switches Q1 3 and Q2 55 may run at arbitrary frequencies. For EMI purposes, their synchronization may be considered. The voltage level of the voltage controller may be set permanent, or may be adjusted by a required secondary current.

The off-line driver 140 is based on the converter 150 (FIG. 8) and further comprises:

Input fuse 30 connected between an AC line and the input terminal of the bridge 2;

First switch 3 with its first terminal connected to the positive terminal of the bridge 2 and the second terminal connected to the first terminal of the current sense resistor 33, and the control terminal connected to the gate resistor 32;

Current sense resistor 33 with its second terminal connected to the system ground;

Second switch 55 with its first terminal connected to the second terminal of current sense resistor 56, with its second terminal connected to the first terminal of the primary winding of transformer 48, and with its control terminal connected to the gate resistor 57;

Current sense resistor 57 with its first terminal connected to the system ground;

Power inductor 4 with its first terminal connected to the system ground and with its second terminal connected to the negative terminal of the bridge 2;

Blocking diode 12 with its anode connected to the negative terminal of the bridge 2 and its cathode connected to the second terminal of the primary winding of the transformer 48;

First stage capacitive filter 54 connected between the cathode of the blocking diode 12 and the system ground;

First stage voltage sensor 58 and 59 connected across the capacitor 54;

$V_{cc}$ capacitor 38 connected between the $V_{cc}$ pin of the controller 170 and the system ground;

$V_{cc}$ energy supply from the first stage filter comprising the blocking diode 41 connected with its anode to the positive rail of filter 54 and its cathode to the current limiting resistor 60, where the resistor 60 is connected with its second terminal to the $V_{cc}$ pin of the controller 170;

Precharging resistor 34, connected to the positive terminal of the bridge 2 and positive terminal of filter 54; and Controller 170 connected with its first output to the gate resistor 32 and its second output to the gate resistor 57, to the first current sense resistor 33 and second current sense resistor 56, to the input voltage sensor 52, 53 to the first stage voltage sensor 58, 59, and to the feedback signal S.

Figure 15:
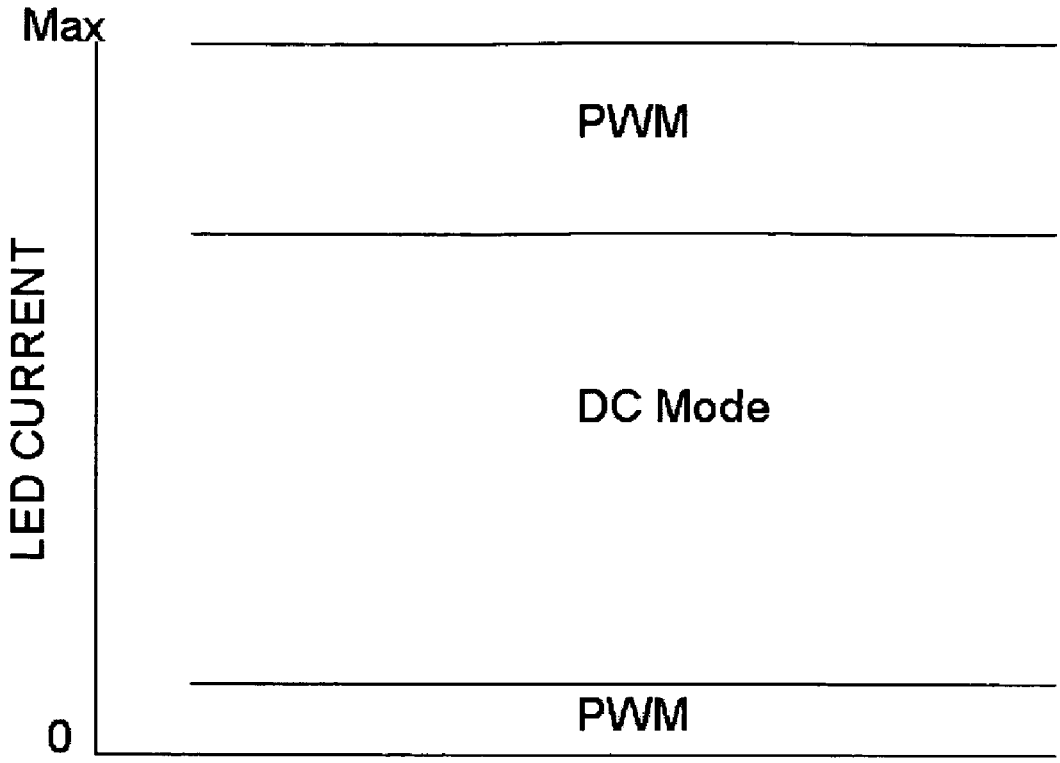
FIG. 15 illustrates DC and PWM modes of driving an LED string.

In FIG. 2, the controller's 21 performance is demonstrated in DC mode. When the required LED current is approaching extreme values, the controller 21 is switched into PWM mode (see FIG. 15). In the PWM mode, the duty cycle is selected such that the junction temperature of the LED will not exceed manufacturing limits. The following process is suggested:

The required system interface LED current is monitored;

The junction temperature of LED is sensed or generated with a no-contact method;

The junction temperature is monitored;

If the required LED current is less than a fixed number (for example 10%), driver is run in the PWM mode for higher accuracy;

If required LED current is more than a fixed number (for example 10%), and junction temperature is less than specified limit, the driver is run in the DC mode; and If the upper limit of the junction temperature is reached, then the controller 21 is turned into a junction temperature regulator with the LED supplied by the PWM mode of operation of the power stage, Foregoing described embodiments of the invention are provided as illustrations and descriptions. They are not intended to limit the invention to precise form described. In particular, it is contemplated that functional implementation of invention described herein may be implemented equivalently in hardware, software, firmware, and/or other available functional components or building blocks, and that networks may be wired, wireless, or a combination of wired and wireless. Other variations and embodiments are possible in light of above teachings, and it is thus intended that the scope of invention not be limited by this Detailed Description, but rather by Claims following.

We claim:

1. An off-line driver for powering a plurality of light emitting diodes, the off-line driver comprising:

a power switch;

an AC bridge, a first terminal of the AC bridge coupled to a first terminal of the power switch;

a magnetic inductor, a first terminal of the magnetic inductor coupled to a second terminal of the AC bridge and couplable through an anode of a rectifier to the plurality of light emitting diodes, and a second terminal of the magnetic inductor couplable to a second terminal of the power switch;

the rectifier, a cathode of the rectifier couplable to the plurality of light emitting diodes; and a regulator, comprising a voltage sense, an error amplifier, an integrator, a comparator, a latch, a switch driver, and a first current sense, the voltage sense couplable through the rectifier or the current sense to the plurality of light emitting diodes, the current sense coupled to the second terminal of the power switch and couplable to the plurality of light emitting diodes; the error amplifier comprising a negative terminal coupled to the current sense and a positive terminal coupled to a combination of a customer set signal and an output signal of an optical model of the plurality of light emitting diodes; the integrator coupled to a reset switch and having an input terminal coupled to the voltage sense, the integrator integrating only during an on-time of the power switch; the comparator comprising a first terminal coupled to an output of the error amplifier and a second terminal coupled to an output of the integrator; the latch comprising a set terminal coupled to an oscillator and a reset terminal coupled to an output of the comparator; and the switch driver coupled to an output of the latch.

2. The off-line driver of claim 1, wherein the optical model is stored and coupled to sensors for determining operational parameters of the plurality of light emitting diodes and ambient temperature, wherein the optical model comprises manufacturing data of the plurality of light emitting diodes for calculation of a luminous output as a function of light emitting diode current and junction temperature of a selected light emitting diode lighting system.

3. The off-line driver of claim 2, wherein the operational parameters comprise a voltage drop across the plurality of light emitting diodes and a current through the plurality of light emitting diodes.

4. The off-line driver of claim 1, further comprising:

an input fuse coupled to an input voltage;

an input electromagnetic interference filter coupled across the input voltage;

a gate drive resistor coupled between the power switch and the regulator;

a primary current sense coupled between the second terminal of the power switch and ground;

a Vcc precharge current resistor coupled between first terminal of the AC bridge and a Vcc capacitor;

a Vcc protection zener diode coupled across the Vcc capacitor;

an output voltage sense coupled to the regulator;

a current sense filter coupled between a current sense resistor and the regulator;

a Vcc supply resistor and a diode coupled to an anode of the rectifier; and a light emitting diode filter couplable across an anode of the plurality of light emitting diodes and ground.

5. The off-line driver of claim 1, wherein the magnetic inductor comprises a transformer, the transformer comprising:

a first terminal of a first primary winding coupled to the second terminal of the power switch, a second terminal of the first primary winding coupled to the second terminal of the AC bridge, and a secondary winding couplable via the rectifier to the plurality of light emitting diodes in a flyback configuration; and wherein the off-line driver further comprises:

a circuit generating a voltage sense signal proportional to a voltage sense voltage across the plurality of light emitting diodes;

a primary capacitive filter coupled across an output of the AC bridge; and a secondary capacitive filter coupled across the plurality of light emitting diodes.

6. The off-line driver of claim 5, wherein a voltage $V_c$ sensed by the voltage sense is measured by computing:

$$Vc = \frac{\Delta I_{p2} V_s t_{ons}}{N t_{rs} \Delta I_{p1}}$$

wherein $\Delta I_{p1}$ is a change of a primary current of the transformer, $\Delta I_{p2}$ is a change of a secondary current, $V_s$ is an instantaneous rectified AC voltage, $t_{ons}$ is an on-time for the power switch, N is a transformer ratio, and $t_{rs}$ is a reset time for the power switch.

7. The off-line driver of claim 5, wherein a signal $I_c$ measured by the current sense is measured by computing:

$$I_c = \frac{N * I_{p1} * t_{rs}}{2T}$$

wherein $I_{p1}$ is a primary peak current,

T is a cycle time,

N is a transformer ratio, and $t_{rs}$ is a reset time for the power switch.

8. The off-line driver of claim 5, wherein the voltage $V_c$ sensed by the voltage sense is calculated by:

turning on the power switch;

acquiring $V_s$, $t_{ons}$, $\Delta I_{p1}$, wherein $V_s$ is an instantaneous rectified AC voltage, $t_{ons}$ is an on-time for the power switch, and $\Delta I_{p1}$ is a change of a primary current of the transformer;

turning off the power switch;

acquiring N, $t_{rs}$, $\Delta I_{p2}$, where N is a transformer ratio, $t_{rs}$ is a reset time for the power switch, and $\Delta I_{p2}$ is a change of a secondary current; and calculating $V_c$ by solving:

$$Vc = \frac{\Delta I_{p2} V_s t_{ons}}{N t_{rs} \Delta I_{p1}}.$$

9. The off-line driver of claim 5, wherein when $N\Delta I_{p1}=\Delta I_{p2}$, where N is a transformer ratio, $\Delta I_{p1}$ is a change of a primary current of the transformer, and $\Delta I_{p2}$ is a change of a secondary current, the voltage $V_c$ sensed by the voltage sense is calculated by:

starting a cycle;

turning on the power switch;

acquiring $V_s$, $t_{ons}$, wherein $V_s$ is an instantaneous rectified AC voltage, and $t_{ons}$ is an on-time for the power switch;

turning off the power switch;

acquiring $t_{rs}$, wherein $t_{rs}$ is a reset time for the power switch; and calculating $V_c$ by solving:

$$Vc = \frac{\Delta I_{p2} V_s t_{ons}}{N t_{rs} \Delta I_{p1}}.$$

10. The off-line driver of claim 5, further comprising:

an input fuse coupled between an AC line and an input terminal of the AC bridge;

a current sense resistor coupled in series with the power switch;

a voltage sense resistive divider coupled across the power switch;

a Vcc capacitor coupled via a second rectifier to the second primary winding of the transformer; and a Vcc protection zener diode coupled across the Vcc capacitor.

11. The off-line driver of claim 10, wherein the regulator further comprises a gate resistor, a current sense resistor, the Vcc capacitor, and the voltage sensor.

12. The off-line driver of claim 1, wherein the magnetic inductor is a transformer having a primary winding and a secondary winding, wherein the second terminal of the power switch is coupled to a first terminal of a first current sense resistor and a control terminal of the power switch is coupled to a first gate resistor; and wherein the off-line driver further comprises:

an input fuse coupled between an AC line and an input terminal of the AC bridge;

the first current sense resistor having a second terminal coupled to a system ground;

a second switch, comprising: a first terminal coupled to a second terminal of a second current sense resistor, and a second terminal coupled to the first terminal of the primary winding of the transformer, and a control terminal coupled to a second gate resistor;

a third current sense resistor comprising a first terminal coupled to the system ground;

a first stage capacitive filter coupled between a blocking diode and the system ground;

a first stage voltage sensor coupled across the first stage capacitive filter;

a Vcc capacitor coupled between the regulator and the system ground; and a Vcc energy supply from the first stage filter comprising the blocking diode, wherein the blocking diode comprises an anode coupled to a positive rail of the first stage capacitive filter, and the cathode coupled to a current limiting resistor, wherein the current limiting resistor comprises a second terminal coupled to the regulator.

13. The off-line driver of claim 12, wherein the regulator comprises:

a first output coupled to the first gate resistor;

a second output coupled to the second gate resistor; and a plurality of inputs correspondingly coupled to the first and second current sense resistors, an input voltage sensor, the first stage voltage sensor, and a feedback signal.

14. The off-line driver of claim 1, wherein the second terminal of the magnetic inductor is coupled through a primary current sense resistor to the second terminal of the power switch.

15. The off-line driver of claim 1, wherein the second terminal of the magnetic inductor is coupled to a ground potential.

16. The off-line driver of claim 1, wherein the current sense comprises a first resistor and is coupled to the second terminal of the power switch through a second current sense resistor.

17. The off-line driver of claim 16, wherein the first resistor and the second current sense resistor are coupled to a ground potential.

18. A method of providing power to a plurality of light emitting diodes (LEDs), comprising:

(a) generating a DC voltage for application to the plurality of light emitting diodes;

(b) amplifying an error between a light emitting diode current and a current reference value;

(c) integrating the DC voltage to provide an integrated signal; and (d) identifying an on-time of a converter, wherein the on-time comprises a time period beginning when the integrating starts and ending when the integrated signal is equal to the amplified error.

19. The method of claim 18, wherein the generating step (a) further comprises:

(a1) maintaining a constant operational frequency for the converter; and (a2) maintaining the on-time of the converter during a cycle of an input voltage.

20. The method of claim 18, wherein the amplifying step (b) further comprises:

(b1) generating the current reference level;

(b2) generating an optical model by acquiring operational parameters of the plurality of LEDs and ambient temperature, and using manufacturing data of the plurality of light emitting diode's luminous output as a function of light emitting diode current and junction temperature of a selected light emitting diode lighting system; and (b3) using an output of the optical model to synthesize the current reference level by dynamically adjusting luminous output signal requirements.

21. The method of claim 20, further comprising:

(b4) generating an optical feedback signal.

22. The method of claim 21, wherein the generating step (b4) further comprises:

(b4i) storing in digital form a number of serially coupled plurality of LEDs;

(b4ii) storing in digital form a manufacturing relationship between V/I electrical signal and an optical output;

(b4iii) measuring a voltage across the serially coupled plurality of light emitting diodes and converting the measure voltage into digital form;

(b4iv) measuring a current through the plurality of light emitting diodes and converting it into digital form;

(b4v) calculating a V/I point;

(b4vi) using manufacturing data to calculate the optical output;

(b4vii) converting the optical output from digital to analog form;

(b4viii) comparing the optical output with a set signal in the error amplifier; and (b4vix) using the error amplifier signal as a set signal in the converter.

23. The method of claim 22, wherein the generating step (b4) further comprises:

(b4i) storing in digital form a number of serially coupled plurality of LEDs;

(b4ii) storing in digital form a manufacturing relationship between V/I electrical signal and an optical output;

(b4iii) measuring a voltage across the serially coupled plurality of LEDs and converting the measure voltage into digital form;

(b4iv) measuring a current through the plurality of LEDs and converting it into digital form;

(b4v) calculating power loss in a single LED by multiplying the measured voltage by a current and dividing by the number of the plurality of LEDs;

(b4vi) sensing an ambient temperature and converting the ambient temperature into digital form;

(b4vii) calculating an LED junction temperature by addition the ambient temperature to a product of power losses in an LED;

(b4viii) converting the junction temperature into an analog signal;

(b4vix) comparing the junction temperature with a set signal in the error amplifier; and (b4x) using the error amplifier signal as a set signal in the converter.

24. The method of claim 21, wherein the generating step (b4) further comprises:

(b4i) storing a relationship between a W/B ratio and a junction temperature in digital form;

(b4ii) measuring a total radiant energy (W) of a radiant energy and converting the total radiant energy into digital form;

(b4iii) measuring the radiant energy within a blue emission B and converting it into digital form;

(b4iv) calculating the W/B ratio;

(b4v) calculating the junction temperature;

(b4vi) converting a junction temperature signal into analog form;

(b4vii) comparing the junction temperature with a set signal in the error amplifier; and (b4viii) using the error amplifier signal as a set signal in the converter.

25. An apparatus for powering a plurality of light emitting diodes, the apparatus comprising:

an AC rectifier;

a power switch coupled to the AC rectifier;

a first diode couplable through a cathode terminal to the plurality of light emitting diodes;

an inductive circuit element coupled to the AC rectifier and to a ground potential, the inductive circuit element further coupled to an anode terminal of the first diode;

a voltage sensor couplable to the plurality of light emitting diodes;

a first current sensor couplable to the plurality of light emitting diodes; and a regulator coupled to control the power switch in response to at least one operational parameter; the regulator comprising an error amplifier to provide an error signal from a reference temperature level and a sensed temperature level of the plurality of light emitting diodes.

26. The apparatus of claim 25, wherein the operational parameter is at least one of the following parameters: brightness, current, voltage, or junction temperature.

27. The apparatus of claim 25, wherein the power switch is coupled through a second current sensor to the ground potential.

28. The apparatus of claim 25, further comprising:

an output filter capacitor coupled to the cathode terminal of the first diode and to the first current sensor or to the ground potential.

29. The apparatus of claim 25, wherein the voltage sensor is a resistive voltage divider coupled in parallel to the inductive circuit element.

30. The apparatus of claim 25, wherein the voltage sensor is a resistive voltage divider couplable in parallel to the plurality of light emitting diodes.

31. The apparatus of claim 25, wherein the regulator comprises:

an error amplifier to provide an error signal from a reference level and a sensed current level of the plurality of light emitting diodes.

32. The apparatus of claim 31, wherein reference level is a junction temperature, an optical output, or a selected current level.

33. The apparatus of claim 25, wherein regulator comprises:

a voltage integrator to provide an output signal proportional to an on-time duration of the power switch and at least one voltage level of the following voltage levels: a rectified voltage, a voltage drop across the plurality of light emitting diodes, or a voltage level of the inductive circuit element.

34. The apparatus of claim 25, wherein the regulator comprises:

an error amplifier to provide an error signal from a reference level and a sensed current level of the plurality of light emitting diodes;

a voltage integrator to provide an integrator output signal proportional to a rectified voltage and an on-time duration of the power switch; and a comparator to provide a signal to turn the power switch into an off state or an on state in response to a difference between the error signal and the integrator output signal.

35. The apparatus of claim 34, wherein the stored optical model comprises one or more of the following: a number "N" of the plurality of light emitting diodes, output brightness, junction temperature, a voltage and current (V/I) parameter for an optical output, a current parameter for optical output, or thermal resistance pin to junction (Rpj).

36. The apparatus of claim 25, wherein the regulator controls the on and off states of the power switch by comparing a sensed voltage or current level with a stored optical model of the plurality of light emitting diodes.

37. The apparatus of claim 25, wherein the regulator uses a stored optical model of the plurality of light emitting diodes to determine a luminous output as a function of light emitting diode current, a voltage drop across the plurality of light emitting diodes, and junction temperature.

38. The apparatus of claim 25, further comprising:

a first radiant energy sensor for total emission;

a second radiant energy sensor for a blue emission; and wherein the regulator determines a junction temperature of the plurality of light emitting diodes as a function of a ratio of total radiant energy to blue radiant energy.

39. The apparatus of claim 25, wherein the inductive circuit element comprises a transformer, the transformer having at least one primary winding coupled to the power switch and to the AC rectifier, and having a secondary winding coupled to the anode of the first diode for coupling to the plurality of light emitting diodes.

40. The apparatus of claim 25, wherein the apparatus further comprises:

a second power switch coupled to the regulator; and wherein the inductive circuit element comprises:

an inductor coupled to the AC rectifier and coupled through a resistor to the power switch; and a transformer, the transformer having at least one primary winding coupled to the second power switch and coupled via a second diode to the AC rectifier and the inductor, and having a secondary winding coupled to the anode terminal of the first diode for coupling to the plurality of light emitting diodes.

41. The apparatus of claim 25, wherein the regulator is adapted to control the first power switch in a pulse-width modulation mode to maintain a junction temperature of the plurality of light emitting diodes below a specified limit.

* * * * *